US006739383B1

(12) United States Patent
Marchionni et al.

(10) Patent No.: US 6,739,383 B1
(45) Date of Patent: May 25, 2004

(54) METHOD FOR CONTINUOUSLY CASTING BETWEEN TWO ROLLS AUSTENITIC STAINLESS STEEL STRIPS WITH EXCELLENT SURFACE QUALITY AND RESULTING STRIPS

(75) Inventors: Christian Marchionni, Rosselange (FR); Frédéric Mazurier, Bethune (FR); Jean-Michel Damasse, Dusseldorf (DE); Frédéric Descaves, Isbergues (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/959,210

(22) PCT Filed: Apr. 12, 2000

(86) PCT No.: PCT/FR00/00780

§ 371 (c)(1),
(2), (4) Date: Jan. 14, 2002

(87) PCT Pub. No.: WO00/13889

PCT Pub. Date: Nov. 2, 2000

(51) Int. Cl.[7] ..... B22D 11/06
(52) U.S. Cl. ..... 164/480; 164/428
(58) Field of Search ..... 164/428, 480

(56) References Cited

U.S. PATENT DOCUMENTS 5,807,444 A * 9/1998 Paradis et al. ..... 148/542

* cited by examiner

*Primary Examiner*—Kuang Y. Lin
(74) *Attorney, Agent, or Firm*—Sughrue Mion, PLLC

(57) ABSTRACT

The invention concerns a method for continuously casting an austenitic stainless steel strip with a thickness not more than 10 mm, directly from liquid metal, between two cooled horizontal rolls, characterised in that: said steel composition in weight proportions comprises: %C≦0.08%; %Si≦1; %P≦0.04; %Mn≦2; %Cr between 17 and 20; %Ni between 8 and 10.5; %S between 0.007 and 0.040; the rest being iron and the impurities resulting from preparation; the ratio $Cr_{eq}/Ni_{eq}$ ranges between 1.55 and 1.90 with: $Cr_{eq}$(%)= %Cr+1.37 %Mo+1.5 %Si+2%Nb+3 %Ti; $Ni_{eq}$(%)=%Ni+ 0.31 %Mn+22 %C+14.2 %N+Cu; the surface of the rolls comprises contiguous dimples with more or less circular or elliptical cross-section, of diameter between 100 and 1500 μm and depth between 20 and 150 μm; the inerting gas surrounding the meniscus is a gas soluble in steel or a mixture of such gases, or consists of at least 50% by volume of such a gas or mixture of gases.

4 Claims, 1 Drawing Sheet

METHOD FOR CONTINUOUSLY CASTING BETWEEN TWO ROLLS AUSTENITIC STAINLESS STEEL STRIPS WITH EXCELLENT SURFACE QUALITY AND RESULTING STRIPS

BACKGROUND OF THE INVENTION

The invention relates to the continuous casting of metals, and more specifically to the continuous casting, directly from liquid metal, of austenitic-type stainless steel strip whose thickness is of the order of a few mm, using the process called "twin-roll casting".

In recent years considerable progress has been made in the development of processes for casting thin carbon steel or stainless steel strip directly from liquid metal. The process mainly used at the present time is that of casting said liquid metal between two internally cooled rolls, rotating about their horizontal axes in opposite directions and placed opposite one another, the minimum distance between their surfaces being approximately equal to the thickness that it is desired to give the cast strip (for example, a few mm). The casting space containing the liquid steel is defined by the lateral surfaces of the rolls, on which the strip starts to solidify, and by lateral closure plates made of refractory which are applied against the ends of the rolls. The liquid metal starts to solidify on contact with the external surfaces of the rolls, on which it forms solidified "shells", arrangements being made for the shells to join together in the "nip", that is to say the region where the distance between the rolls is a minimum.

One of the main problems encountered when manufacturing thin stainless steel strip by twin-roll casting is that there is a high risk of surface defects called microcracks appearing on the strip. These cracks are small, but they are nevertheless sufficient to make the resulting cold-converted products unsuitable for use. The microcracks form during solidification of the steel and have a depth of about 40 $\mu$m and an opening of approximately 20 $\mu$m. Their appearance depends on the contractions of the metal, during solidification of the shells on contact with the rolls over the length of their contact arc. This solidification may be described as having two successive steps. The first step takes place during the initial contact between the liquid steel and the surface of the roll, which results in the formation of a solid steel shell at the surface of the rolls. The second step relates to the growth of this shell as far as the nip, where, as mentioned, it joins the shell formed on the other roll in order to constitute the fully solidified strip. The contact between the steel and the surface of the roll is determined by the topography of the surface of the casting rolls, together with the nature of the inert gas surrounding the casting space and the chemical composition of the steel. All these parameters are involved in establishing the heat transfer between the steel and the roll and govern the conditions under which the shells solidify. As the shells solidify and cool, they undergo contractions. These depend especially on the extent of the $\delta \rightarrow \gamma$ phase transformation, which takes place with a substantial change in the density of the metal, at the microscopic level. It is determined by the composition of the cast metal. These contractions will also modify the shell solidification and cooling conditions.

The $Cr_{eq}/Ni_{eq}$ ratio is conventionally considered as being representative of the solidification path of austenitic stainless steels. It is calculated, using the Hammar and Swensson relationship, by means of the formulae (the percentages are weight percentages):

$$Cr_{eq}(\%)=Cr\%+1.37Mo\%+1.5Si\%+2Nb\%+3Ti\%$$

$$Ni_{eq}(\%)=Ni\%+0.31Mn\%+22C\%+14.2N\%+Cu\%.$$

Various attempts have been made to develop twin-roll casting processes for obtaining, reliably, strip free of unacceptable surface defects such as microcracks.

With regard to austenitic stainless steels, mention may be made of the document EP-A-0 409 645. This combines a defined geometry of "dimples" (etched valleys of roughly circular or elliptical shape) present on the surface of the rolls with the use as inert gas of a gas mixture containing 30 to 90% of a gas soluble in the steel, which coats the dimples at the moment of the first roll/liquid steel contact. The document EP-A-0 481 481 combines a chemical composition, in which the $\delta$-$Fe_{ca1}$ index defined by $\delta$-$Fe_{ca1}$=3 (Cr %+1.5Si %+Mo %)−2.8 (Ni %+0.5Mn %+0.5Cu %)−84 (C %+N %)−19.8 is between 5 and 9%, with a dimple geometry on the rolls, so as to encourage solidification as primary ferrite $\delta \rightarrow \delta+\gamma$. The dimples may conventionally be produced by shot blasting or laser machining. In both the above documents, there is a requirement for these dimples to be separated from one another.

The document EP-A-0 679 114 proposes the use of circumferential grooves made on the surface of the rolls, which give said surface a roughness Ra of 2.5 to 15 $\mu$m. It is combined with a chemical composition of the steel allowing solidification as primary austenite, characterized by a $Cr_{eq}/Ni_{eq}$ ratio of less than 1.60. However, solidification as primary austenite increases the hot cracking sensitivity of stainless steels and the risks of forming longitudinal cracks in the strip.

The document EP-A-0 796 685 teaches the casting of a steel whose $Cr_{eq}/Ni_{eq}$ ratio is greater than 1.55 so as to minimize the phase changes at high temperature and to carry out this casting by using rolls whose surface includes touching dimples 100–1500 $\mu$m in diameter and 20–150 $\mu$m in depth and by inerting the region around the meniscus (the intersection between the surface of the liquid steel and the surface of the rolls) with a gas soluble in the steel, or a gas mixture composed predominantly of such a soluble gas. The roughness peaks serve as sites for initiating the solidification, whereas the valleys of the roughness constitute metal contraction joints during solidification, and allow better distribution of the stresses. However, when the $CR_{eq}/Ni_{eq}$ ratio is greater than 1.70, it is not always possible to avoid the presence of a few microcracks.

SUMMARY OF THE INVENTION

It is an object of the invention to provide a process for the casting of thin austenitic stainless steel strip whose surface is free of microcracks and of other major defects, not requiring particularly demanding casting conditions for implementing it and making it possible to cast steels having a more extended $CR_{eq}/Ni_{eq}$ ratio than in the existing processes.

For this purpose, the subject of the invention is a process for the continuous casting of an austenitic stainless steel strip having a thickness of less than or equal to 10 mm, directly from liquid metal, between two cooled horizontal rolls, characterized in that:

the composition of said steel, in percentages by weight, comprises: C %≦0.08; Si %≦1; P %≦0.04; Mn %≦2; Cr % between 17 and 20; Ni % between 8 and 10.5; S % between 0.007 and 0.040; the balance being iron and impurities resulting from the smelting;

the $Cr_{eq}/Ni_{eq}$ ratio is between 1.55 and 1.90 with:

$$Cr_{eq}(\%)=Cr\%+1.37Mo\%+1.5Si\%+2Nb\%+3Ti\%$$

and $$Ni_{eq}(\%)=Ni\%+0.31Mn\%+22C\%+14.2N\%+Cu\%;$$

the surface of the rolls has touching dimples of approximately circular or elliptical cross section, having a diameter of 100 to 1500 μm and a depth of 20 to 150 μm;

the inert gas surrounding the meniscus is a gas soluble in the steel or a mixture of such gases, or consists of at least 50% by volume of such a gas or gas mixture.

The subject of the invention is also strip that can be produced by this process.

As will have been understood, the invention consists in combining conditions relating to the composition of the cast metal, the surface finish of the rolls and the composition of the gas for inerting the meniscus, so as to obtain a strip surface free of microcracks. The main novelty of the composition required is that the metal must contain an amount of sulfur greater than the amounts more usually encountered (without, however, being high to the point of compromising the corrosion resistance of the products) and that this content must be combined with a precise range of $Cr_{eq}/Ni_{eq}$ ratios.

BRIEF DESCRIPTION OF THE DRAWINGS

The invention will be more clearly understood on reading the description which follows, given with reference to the following appended figures.

DETAILED DESCRIPTION OF THE INVENTION

Figure 1:
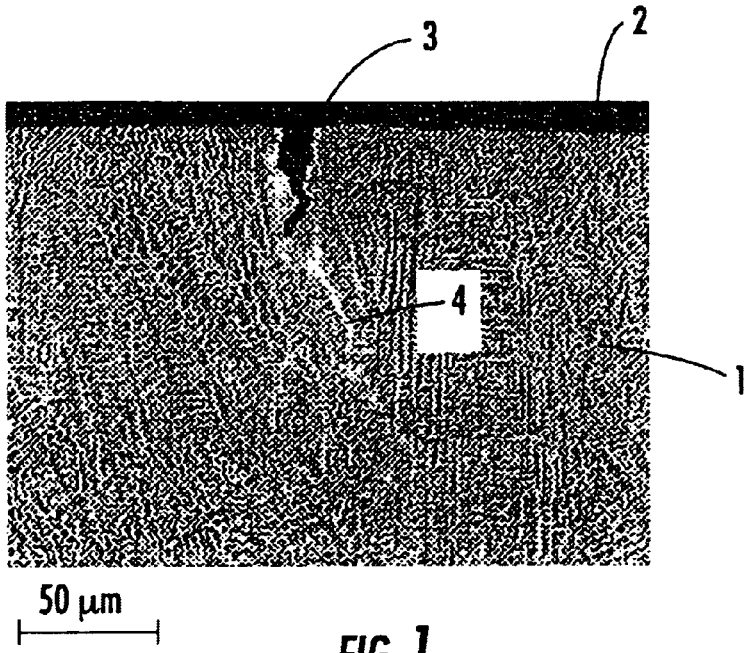
FIG. 1, which shows, seen in cross section, an austenitic stainless steel strip cast between rolls according to the prior art, and which demonstrates the morphology of the microcracks that it is desired to prevent.

The conditions under which the liquid steel first comes into contact with the rolls constitute a very important factor in the process of strip solidification and have an appreciable influence on the surface quality of the strip. It is therefore very important for them to be well controlled in order to guarantee the absence of microcracks on the cast strip. However, the inevitable fluctuations in the level of the surface of the liquid metal present between the rolls complicate this control, especially as they are a source of irregularities in the heat exchange taking place in this region of first contact. Other such irregularities are due, during the subsequent stages in the solidification of the shells, to the contractions of the metal during solidification, which in particular result in high-temperature phase transformations characteristic of austenitic stainless steels. These contractions may be the cause of microcracks. FIG. 1 shows a micrograph taken on a specimen of a thin austenitic stainless steel strip 1, seen in longitudinal section. This strip 1 has on its surface 2 a microcrack 3 of the type of those that the invention aims specifically to prevent. The metallographic etching carried out in the specimen reveals a light area 4 located around the microcrack 3 and along its extension: it corresponds to a segregated region enriched with certain elements such as nickel and manganese.

It has been discovered that adding surface-active elements to the liquid metal, such as sulfur, which act on the surface tension of the liquid steel at the surface of the rolls, has an appreciable influence on the conditions under which the metal first comes into contact with the casting rolls. In particular, such an addition allows the shape of the liquid metal meniscus to be very substantially stabilized by virtue of better wetting of the surface of the roll. This results in a significant improvement in the homogeneity and regularity over time in the heat exchange between the liquid metal and the surface of the rolls during their first contact therewith. These effects had been demonstrated by the inventors based on measurements of the regularity of the thicknesses of columnar shells produced on metallographic sections in the transverse direction of as-cast thin strip made of an austenitic stainless steel of the 304 type. Any irregularity in these thicknesses is manifested by a high propensity of the cast strip to exhibit microcracks on its surface. In contrast, a regular thickness of the columnar part of the solidified shell, which is the indicator that the level of the meniscus has varied only a little during casting, goes hand in hand with the absence of microcracks at the surface of the strip.

Figure 2:
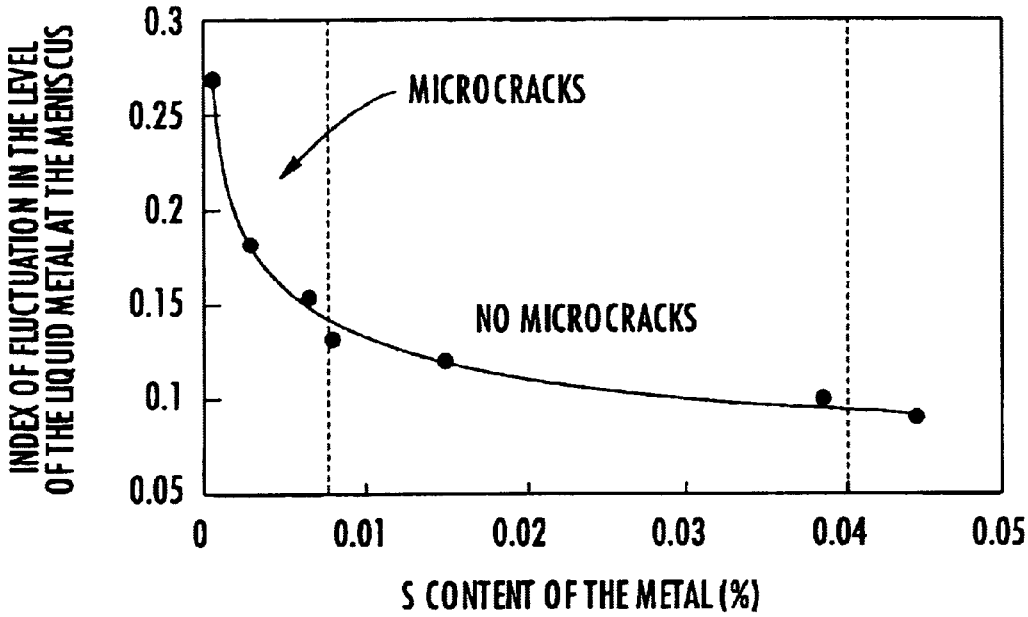
FIG. 2, which is a curve showing the influence of the sulfur content of the metal on the presence of microcracks on the surface of the cast strip.

The curve in FIG. 2 shows the results of these investigations, which were made on strip 3 mm in thickness cast at a rate of 50 m/min. The surfaces of the casting rolls were roughened by touching dimples having a mean depth of 80 μm and a mean diameter of 1000 μm. The composition of the cast steels fell within the following limits: C: 0.0240–0.06%; Mn: 1.3–1.6%; P: 0.0190–0.024%; Si: 0.344–0.45%; Cr 18.0–18.7%; Ni: 8.6–9.8%; S: 0.0005–0.446%. The $CR_{eq}/Ni_{eq}$ ratios of these steels varied from 1.79 to 1.85. The inert gas surrounding the meniscus contained 60% nitrogen by volume and 40% argon by volume. Plotted on the x-axis is the sulfur content of the metal and plotted on the y-axis is an index representative of the magnitude of the fluctuations in the meniscus level during casting, which represents the standard deviation on the thickness of the columnar regions observed in the solidification structure of the strip. It may be seen that, for the same casting conditions, the higher the sulfur content of the metal, while moreover the contents of the other elements remain similar, the smaller the amplitude of the fluctuations in the level of the meniscus. Above a sulfur content of 0.007%, this influence decreases very significantly, whereas it remains very pronounced for the lower contents. It should also be realized that the presence of microcracks at the surface of the strip is directly related to these fluctuations and that the lower limit of 0.007% for the sulfur content also corresponds to the minimum needed to prevent the formation of microcracks.

In general, the inventors have determined a set of conditions to be met so that the casting of austenitic stainless steels as thin strip takes place without the formation of microcracks at the surface of the strip, these conditions having been mentioned above. They are justified by the following considerations.

When the sulfur content is less than 0.007%, the fluctuations in the level of the meniscus become too large and the irregularities in heat transfer which result therefrom cause the formation of microcracks, in particular when the $CR_{eq}/Ni_{eq}$ ratio is greater than 1.70. The upper limit of the sulfur content is set at 0.04% because above this value the influence of the sulfur content on the stability of the meniscus no longer increases significantly and, on the other hand, there is an increase in the risk of degrading the pitting corrosion resistance of the finished product manufactured from this strip.

The phosphorus content must be kept at less than 0.04% so as to avoid the risk of hot cracking of the strip when the $CR_{eq}/Ni_{eq}$ ratio is close to 1.55, that is to say when solidification takes place partially as primary austenite and not predominantly as primary ferrite.

The $Cr_{eq}/Ni_{eq}$ ratio must be at least 1.55, as below this value the steel solidifies at least partially as primary austenite, thereby increasing the cracking sensitivity of the strip and promoting the appearance of longitudinal cracks, which must also be absolutely prevented. For a $Cr_{eq}/Ni_{eq}$ ratio greater than 1.90, the contraction owing to the ferrite-austenite transformation becomes too great and microcracks are then inevitable. In addition, the ferrite content of the strip becomes too high, which may result in fractures after the operation of forming the finished products produced from the strip thus cast.

The other analytical conditions on the cast steel are conventional with regard to the most common austenitic stainless steels, especially those of the 304 and similar type. Of course, elements other than those explicitly mentioned in the foregoing may be present in the steel as impurities or as alloying elements in small amounts, provided that they do not appreciably modify the solidification conditions and the surface tension of the liquid steel at the surface of the rolls, which would be confirmed by the absence of microcracks on the strip produced.

As was mentioned, the nature of the inert gas surrounding the meniscus has a strong influence on the conditions under which the steel is in contact with the surface of the rolls, especially on the way in which the transfer takes place "as a negative" of the roughness of the rolls on the surface of the strip, and on the risk of forming microcracks. With a gas completely or predominantly insoluble in the steel, such as argon or helium, there is little or no penetration of the solidifying steel into the depressions in the surface of the roll. Heat extraction therefore takes place practically only right at the roughness peaks, which makes the extraction very heterogeneous on the surface of the roll. This heterogeneity is conducive to the formation of numerous microcracks. In contrast, with an inert gas containing an appreciable amount of gas soluble in the steel, such as nitrogen, hydrogen, ammonia or $CO_2$, a fortiori if it consists entirely of such a gas or mixture of such gases, the steel penetrates well into the depressions in the surface of the rolls and heat extraction upon first contact is significant. In addition, this reduces the heterogeneity in the heat extraction right at the peaks and the depressions. All this goes toward limiting the risk of forming microcracks. In practice, taking into account the other required casting conditions with regard to the composition of the metal and the surface roughness of the rolls, the lower limit of the content in the inert gas of a gas (or gas mixture) soluble in the steel is set at 50%.

The conditions described above lead to the desired results if the rolls have on their surface touching dimples with a diameter of between 100 and 1500 $\mu$m and a depth of between 20 and 150 $\mu$m.

Examples of applications will now be given to illustrate the invention and justify its requirements.

EXAMPLE 1

Austenitic stainless steel strip 3 mm in thickness was cast between rolls. The surfaces of the rolls had touching dimples with a mean diameter of 1000 $\mu$m and a mean depth of 100 $\mu$m. The inert gas surrounding the meniscus contained 40% argon and 60% nitrogen. The composition of the steel varied within the following limits: C: 0.02–0.06%; Mn: 1.3–1.6%; P: 0.019–0.024%; Si: 0.34–0.45%; Cr: 18.0–18.7%; Ni: 8.6–9.8%; S: 0.0005–0.0446%. The $Cr_{eq/Nieq}$ ratio of the steels cast varied from 1.79 to 1.85. The surface density of the microcracks on the strip thus cast was measured and the results of these measurements were compared with the sulfur contents in the steels cast. Table 1 gives the conclusions of these trials.

TABLE 1

Effect of the sulfur content of the steel on the surface density of microcracks.

| S % | Number of microcracks per $dm^2$ |
|---|---|
| 0.0005 | 110 |
| 0.0028 | 75 |
| 0.0066 | 10 |
| 0.0075 | 0 |
| 0.0080 | 0 |
| 0.0150 | 0 |
| 0.0388 | 0 |
| 0.0446 | 0 |

In these examples, in which the $Cr_{eq}/Ni_{eq}$ ratio of the steels cast was from 1.79 to 1.85 (and therefore varied only within very narrow limits), it is clearly apparent that the density of microcracks observed depends strongly on the sulfur content of the steel. For sulfur contents greater than 0.007%, no microcracks are observed, whereas for low and very low sulfur contents, microcracks are present in very significant quantity. It was from these results that the curve in FIG. 2 was plotted.

EXAMPLE 2

Austenitic stainless steel strip 3.8 mm in thickness was cast between rolls, the compositions of each steel being given in table 2. The rolls had surface roughnesses characterized by the presence of touching dimples having a mean diameter of 1000 $\mu$m and a mean depth of 120 $\mu$m.

TABLE 2

Chemical composition of the steels of Example 2.

| Steel | C % | Mn % | P % | S % | Si % | Ni % | Cr % | Cu % | Mo % | N % | $Cr_{eq}/Ni_{eq}$ |
|---|---|---|---|---|---|---|---|---|---|---|---|
| A | 0.038 | 0.87 | 0.019 | 0.004 | 0.451 | 8.61 | 18.28 | 0.128 | 0.071 | 0.0456 | 1.82 |
| B | 0.035 | 0.82 | 0.021 | 0.019 | 0.562 | 8.58 | 18.23 | 0.114 | 0.218 | 0.0535 | 1.85 |
| C | 0.015 | 1.57 | 0.020 | 0.005 | 0.510 | 10.16 | 18.25 | 0.108 | 0.082 | 0.0423 | 1.64 |
| D | 0.053 | 1.50 | 0.023 | 0.039 | 0.266 | 9.07 | 18.11 | 0.264 | 0.299 | 0.0509 | 1.62 |

While these steels were being cast, the composition of the inert gas present in the region of the meniscus was varied by changing its respective argon and nitrogen proportions, and the surface density of microcracks observed on the cast strip was measured for the various compositions of the inert gas employed. The results are given in table 3:

TABLE 3

Influence of the composition of the inert gas on the surface density of the microcracks on the strip, according to the sulfur content and the $Cr_{eq}/Ni_{eq}$ ratio of the steel cast.

| % Argon/ % Nitrogen | Micro-cracks/dm$^2$ steel A | Micro-cracks/dm$^2$ steel B | Micro-cracks/dm$^2$ steel C | Micro-cracks/dm$^2$ steel D |
|---|---|---|---|---|
| 0/100 | 200 | 0 | 0 | 0 |
| 10/90 | 290 | 0 | 0 | 0 |
| 20/80 | 280 | 0 | 0 | 0 |
| 30/70 | 320 | 0 | 5 | 0 |
| 40/60 | 330 | 0 | 20 | 0 |
| 50/50 | 370 | 0 | 40 | 0 |
| 60/40 | 350 | 5 | 70 | 15 |
| 70/30 | | 40 | 110 | 30 |
| 80/20 | | 110 | 130 | 120 |

Table 3: Influence of the composition of the inert gas on the surface density of the microcracks on the strip, according to the sulfur content and the $CR_{eq}/Ni_{eq}$ ratio of the steel cast.

These trials show that steel A, which has a satisfactory $CR_{eq}/Ni_{eq}$ ratio but a low sulfur content, systematically results in the formation of numerous microcracks whatever the composition of the inert gas. Steel C has a slightly higher sulfur content, and this is sufficient to improve the surface quality of the strip substantially, since no microcracks are observed when the nitrogen content of the inert gas is at least 80%. However, this result cannot be regarded as entirely satisfactory as this requirement of maintaining the nitrogen content of the inert gas at a high level reduces the operators' chances of finely controlling the operation of the casting plant. This is because the composition of the inert gas is a parameter which it is often desirable to vary in order to control the intensity of the heat transfer between the rolls and the metal, for example in order to vary the crown of the rolls which affects the shape of the strip (see document EP-A-0 736 350). The results obtained with steel C therefore lead to the conclusion that a sulfur content of 0.005% cannot fall within the scope of the invention.

On the other hand, there are no microcracks on strip cast from steels B and D provided that the nitrogen content of the inert gas is at least 50%. Their sulfur contents are 0.019 and 0.039% respectively and their $Cr_{eq}/Ni_{eq}$ ratios are 1.82 and 1.64 respectively. These examples therefore clearly fall within the scope of the invention. The invention preferably applies to the case of steels having a $CR_{eq}/Ni_{eq}$ ratio of between 1.70 and 1.90 since this range corresponds to steels in which a lesser amount of gammagenic elements (such as nickel) has been added than in the case of steels having a lower $Cr_{eq}/Ni_{eq}$ ratio, and which are therefore more economical to manufacture.

What is claimed is:

1. A process for the continuous casting of an austenitic stainless steel strip having a thickness of less than or equal to 10 mm, directly from liquid metal, between two cooled horizontal rolls, comprising the following steps:

choosing the composition of said steel, in percentages by weight, to be: C %≦0.08; Si %≦1; P %≦0.04; Mn %≦2; Cr % between 17 and 20; Ni % between 8 and 10.5; S % between 0.007 and 0.040; the balance being iron and impurities resulting from the smelting;

choosing the $Cr_{eq}/Ni_{eq}$ ratio to be between 1.70 and 1.90 with:

$$Cr_{eq}(\%)=Cr\%+1.37Mo\%+1.5Si\%+2Nb\%+3Ti\%$$

and $$Ni_{eq}(\%)=Ni\%+0.31Mn\%+22C\%+14.2N\%+Cu\%;$$

providing the surface of the rolls with touching dimples of approximately circular or elliptical cross section, having a diameter of 100 to 1500 $\mu$m and a depth of 20 to 150 $\mu$m; and surrounding the meniscus with an inert gas which is a gas soluble in the steel or a mixture of such gases, or is at least 50% by volume of such a gas or gas mixture, to produce a strip surface which is free of microcracks.

2. The process as claimed in claim 1, comprising the step of choosing the inert gas to be composed of a mixture of 50–100% nitrogen and 50–0% argon by volume.

3. An austenitic stainless steel strip obtained by the process as claimed in claim 1.

4. The process as claimed in claim 1, comprising the step of choosing the inert gas to be composed of a mixture of 50–100% nitrogen and 50–0% argon by volume.

* * * * *

UNITED STATES PATENT AND TRADEMARK OFFICE

CERTIFICATE OF CORRECTION

PATENT NO. : 6,739,383 B1 
DATED : May 25, 2004
INVENTOR(S) : Christian Marchionni et al.

It is certified that error appears in the above-identified patent and that said Letters Patent is hereby corrected as shown below:

Title page,
Insert Item -- [30] Foreign Application Priority Data
April 22, 1999 (FR) 990552 --.

Signed and Sealed this

Seventh Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,739,383 B1
APPLICATION NO. : 09/959210
DATED : May 25, 2004
INVENTOR(S) : Christian Marchionni et al.

It is certified that error appears in the above-identified patent and that said Letters Patent is hereby corrected as shown below:

Title page,
Insert Item -- [30] Foreign Application Priority Data
April 22, 1999 (FR) 9905052 --.

This certificate supersedes Certificate of Correction issued February 7, 2006.

Signed and Sealed this

Twentieth Day of June, 2006

JON W. DUDAS
*Director of the United States Patent and Trademark Office*